US006861990B2

(12) United States Patent
Hung et al.

(10) Patent No.: US 6,861,990 B2
(45) Date of Patent: Mar. 1, 2005

(54) ANTENNA WITH METAL GROUND

(75) Inventors: Zhen-Da Hung, Tu-chen (TW); Lung-Sheng Tai, Tu-chen (TW); Chia-Ming Kuo, Tu-chen (TW); Hsien-Chu Lin, Tu-Chen (TW); Yun Long Ke, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 17 days.

(21) Appl. No.: 10/627,526

(22) Filed: Jul. 24, 2003

(65) Prior Publication Data

US 2004/0233110 A1 Nov. 25, 2004

(51) Int. Cl.[7] ..... H01Q 1/36
(52) U.S. Cl. ..... 343/702; 343/830; 343/846
(58) Field of Search ..... 343/702, 826, 343/829, 830, 846, 848

(56) References Cited

U.S. PATENT DOCUMENTS 5,550,554 A * 8/1996 Erkocevic ..... 343/828
5,748,149 A * 5/1998 Kawahata ..... 343/700 MS
6,348,894 B1 * 2/2002 Lahti ..... 343/702
6,433,746 B2 * 8/2002 Kushihi et al. ..... 343/700 MS
6,552,685 B2 4/2003 Zhang
6,606,060 B2 * 8/2003 Park ..... 343/700 MS
6,614,401 B2 * 9/2003 Onaka et al. ..... 343/702
6,661,380 B1 * 12/2003 Bancroft et al. ..... 343/700 MS
6,700,545 B2 * 3/2004 Hareyama ..... 343/702
6,762,724 B2 * 7/2004 Peng ..... 343/702
6,774,849 B2 * 8/2004 Umehara et al. .... 343/700 MS

* cited by examiner

*Primary Examiner*—Shih-Chao Chen
(74) *Attorney, Agent, or Firm*—Wei Te Chung

(57) ABSTRACT

A antenna (1) includes a radiating portion (3), a ground portion (2) and a feed cable (6). The radiating portion includes a printed circuit board (PCB) (31), a radiating element (32) and a mounting portion (33). The radiating element and the mounting portion are separately mounted on a same surface (311) of the PCB. The ground portion has a metal plate (22) and a coupling portion (21) on bottom surface (221) of the metal plate. The coupling portion connects with the mounting portion. The feed cable includes an inner conductor (61) connected with the radiating element and an outer conductor (62) connected with the metal plate.

15 Claims, 3 Drawing Sheets

ANTENNA WITH METAL GROUND

BACKGROUND OF THE INVENTION

1. Field of the Invention

The present invention relates to an antenna, and in particular to a tri-band antenna employed in a mobile electronic device.

2. Description of the Prior Art

U.S. Pat. No. 6,552,685, discloses a flat antenna comprising radiation elements, a first dielectric substrate and a back ground plate. The radiation elements are constituted of a conductive plate provided on the front face of the first dielectric substrate and the back ground plate is constituted of a conductive plate provided on the rear face of the first dielectric substrate. However, the radiation elements, the first dielectric substrate and the back ground plate are integrated to overlap each other and mounted into a mobile electronic device. When the mobile electronic device is vibrated or swayed, friction will be generated between the antenna and the mobile electronic device, which result in that the antenna is damaged and signals transmitted by the antenna is not steadily.

Hence, an improved antenna is desired to overcome the above-mentioned shortcomings of the existing antennas.

BRIEF SUMMARY OF THE INVENTION

It is therefore an object of the present invention to provide an antenna which is securely mounted in a mobile electronic device and transmits signals steadily.

In order to achieve the above object, an aspect of the present invention is an antenna comprising a radiating portion, a ground portion and a feed cable. The radiating portion comprises a printed circuit board(PCB), a radiating element and a mounting portion. The radiating element and the mounting portion are separately mounted on the same surface of the PCB. The ground portion has a metal plate and a coupling portion on surface of the metal plate. The coupling portion is connected with the mounting portion. The feed cable comprises an inner conductor connected with the radiating element and an outer conductor connected with the metal plate.

Other objects, advantages and novel features of the invention will become more apparent from the following detailed description of preferred embodiments when taken in conjunction with the accompanying drawings.

DETAILED DESCRIPTION OF THE INVENTION

One embodiment of the present invention will now be described with reference to the accompanying drawing.

Figure 1:
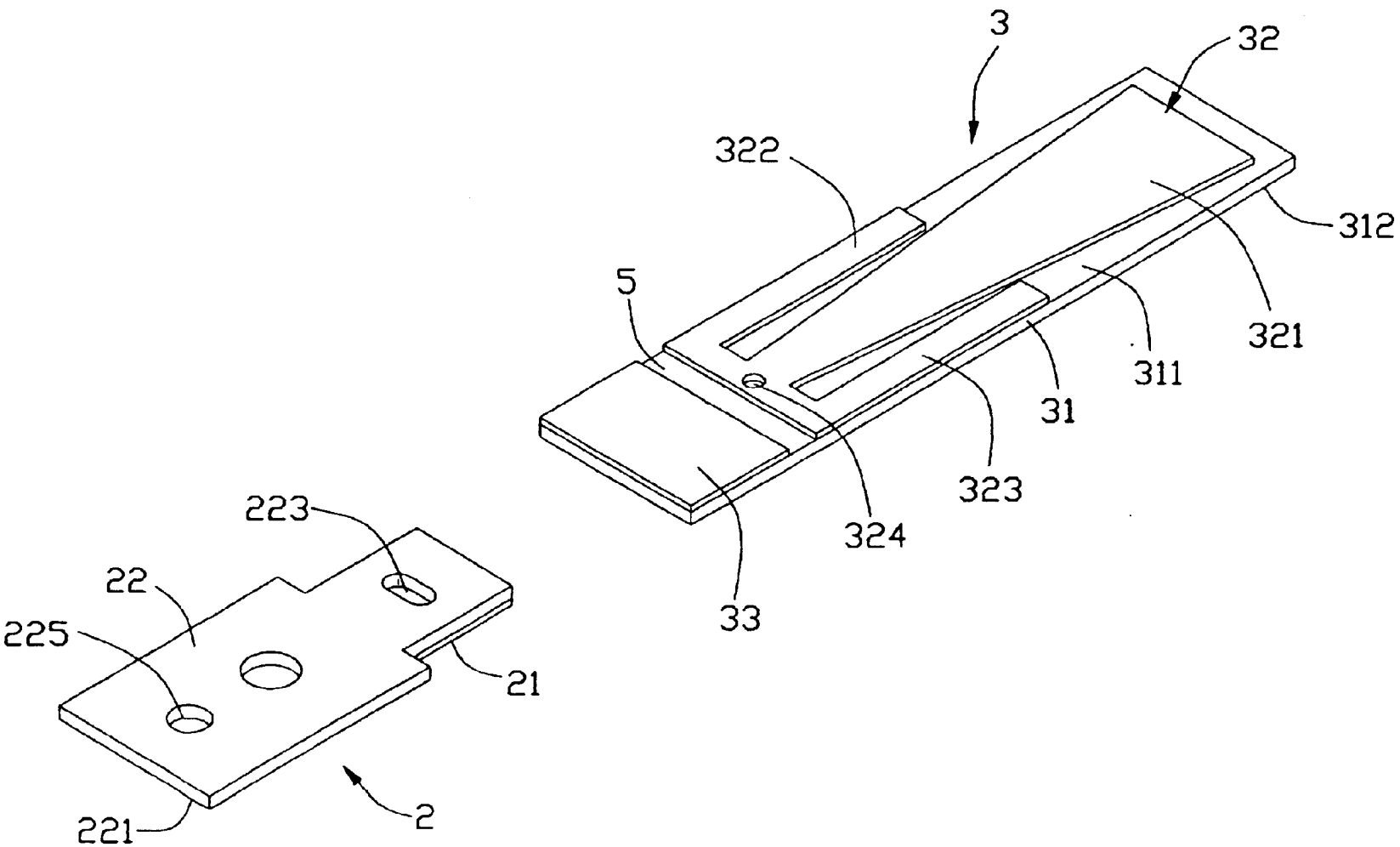
FIG. 1 is a perspective view of a radiating portion and a ground portion of an antenna according to a first embodiment of the present invention.
Figure 2:
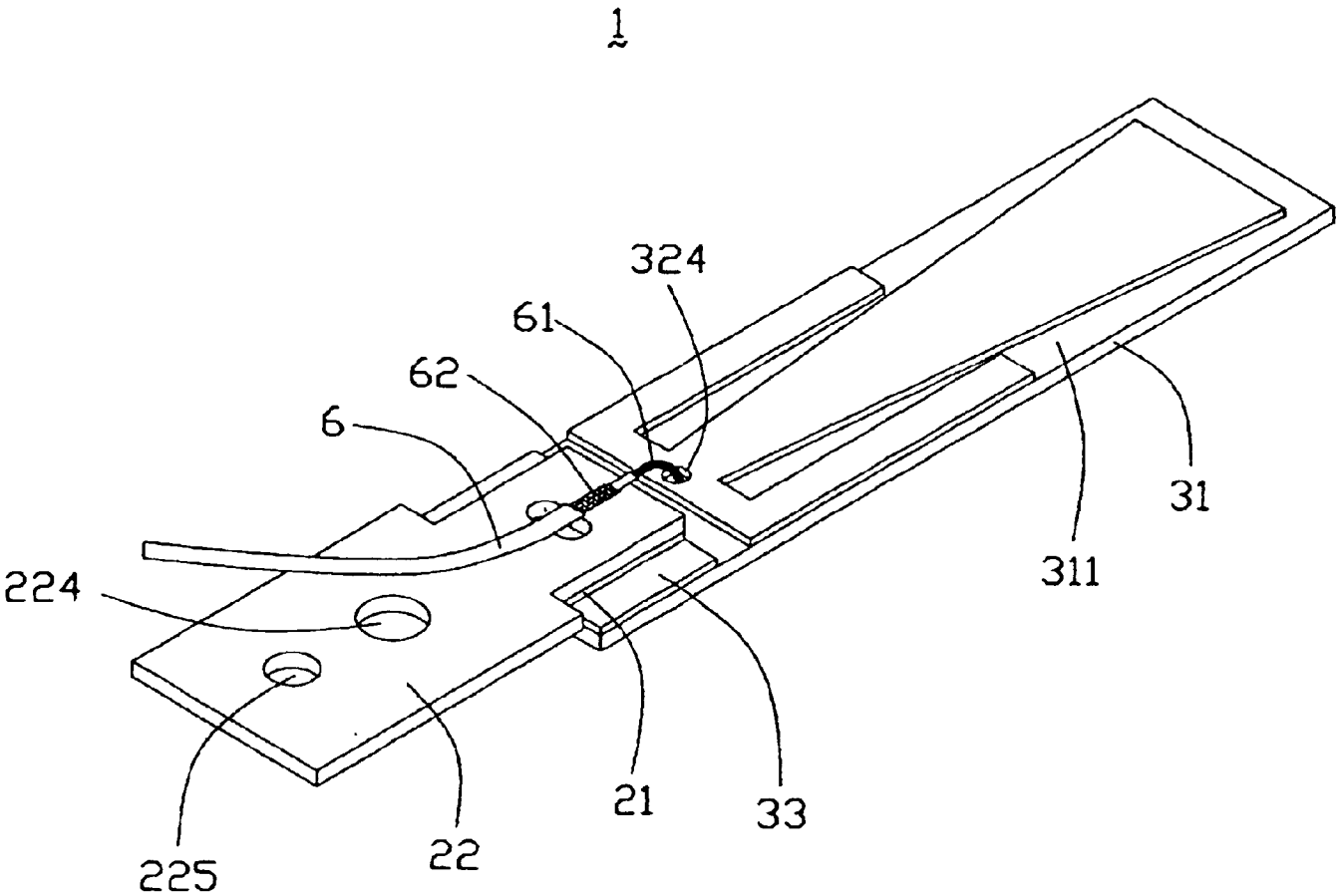
FIG. 2 is a perspective view of the antenna of FIG. 1 further including a feed cable assembled thereto.

Referring to FIG. 1 and FIG. 2, an antenna 1 comprises a radiating portion 3, a ground portion 2 and a feed cable 6. The radiating portion 3 comprises a printed circuit board (PCB) 31, a radiating element 32 and a mounting portion 33.

The ground portion 2 has a metal plate 22 and a coupling portion 21 adhered on bottom surface 221 of the metal plate 22.

The mounting portion 33 is disposed close to a shorter edge on a surface 311 of the PCB 31. The radiating element 32 and the mounting portion 33 are separately mounted on the same surface 311 of the PCB 31. The radiating element 32 comprises a low-frequency portion 321 in center, a through hole 324 defined in one end of the low-frequency portion, a first high-frequency portion 322 extending from one side of the low-frequency portion 321 and a second high-frequency portion 323 extending from the other side of the low-frequency portion 321.

The metal plate 22 comprises an accessional hole 223 for filling solder material, a setting hole 224 for mounting the antenna 1 to a mobile electrical device (not shown) and an orientational hole 225 for limit of rotating. A coupling portion 21 is disposed close to a shorter edge on the bottom surface 221 and is soldered with the mounting portion 33. The coupling portion 21 is made of metallic material or soldering tin.

The feed cable 6 comprises an inner conductor 61 connected with edge of the through hole 324 of the radiating element 32 and an outer conductor 62 connected onto a top surface of the metal plate 22.

Also in a modified embodiment, the feed cable 6 can be disposed under the metal plate 22 when the antenna 1 is used in different conditions.

Figure 3:
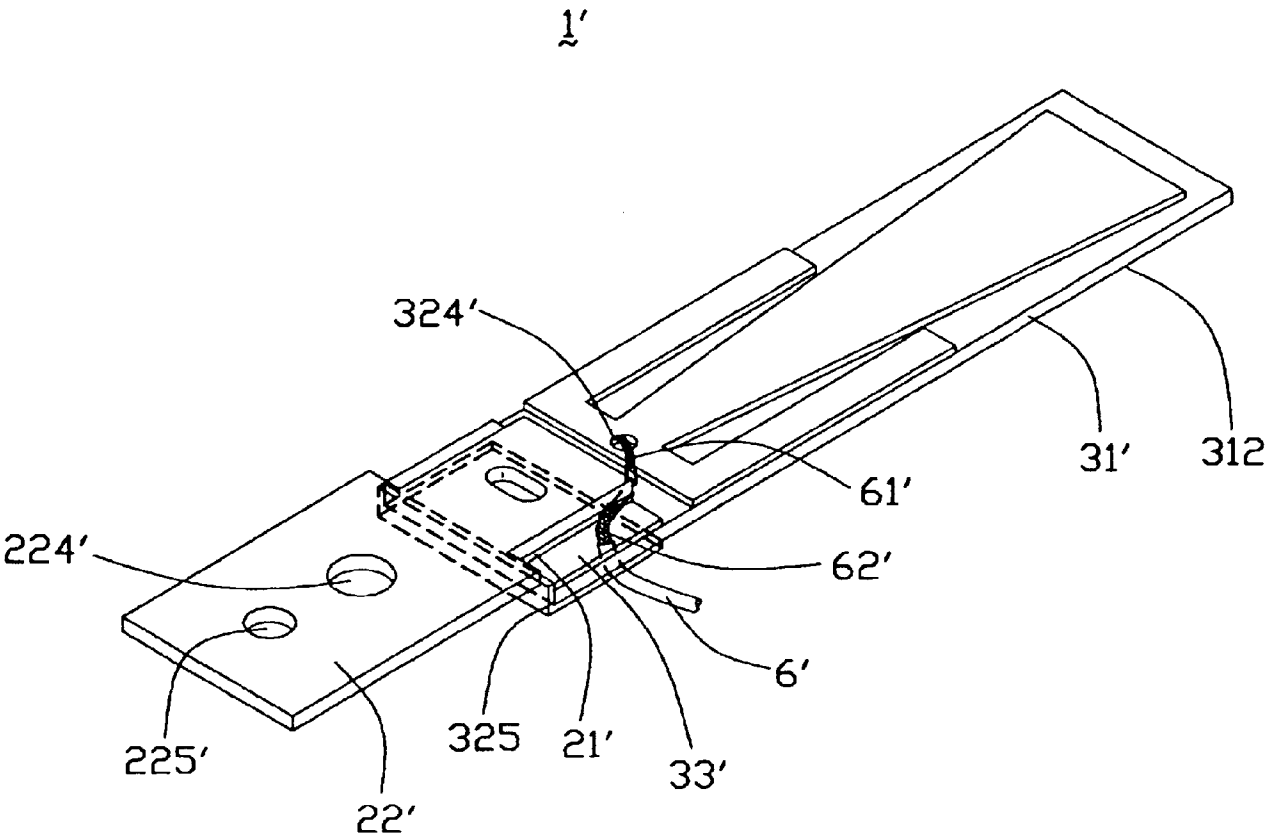
FIG. 3 is a perspective view of an antenna according to a second embodiment of the present invention.

Referring to FIG. 3, a through hole 324' is defined through a bottom surface 312 of the printed circuit board 31'. A conductive layer 325 is disposed on the bottom surface 312 with one end of the conductive layer 325 extending from the bottom surface 312 to the mounting portion 33' and electrically connects with a mounting portion 33'. An inner conductor 61' of a feed cable 6' is connected with edge of the through hole 324' and an outer conductor 62' is connected with the conductive layer 325.

A setting hole 224' and an orientational hole 225' of a metal plate 22' are respectively connect with a mobile electronic device. The metal plate 22' is disposed on one side of the printed circuit board 31'.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna comprising:

a radiating portion comprising a radiating element, a mounting portion and a printed circuit board (PCB), said radiating element and said mounting portion being on a top surface of said PCB;

a ground portion comprising a metal plate and a coupling portion on a bottom surface of said metal plate, said coupling portion physically and electrically connecting with said mounting portion;

a feed cable comprising an inner conductor and an outer conductor respectively connected with said radiating element and said ground portion;

wherein a portion of said metal plate is overlapped on said printed circuit board, the rest portion of said metal plate is separated from said printed circuit board.

2. The antenna according to claim 1, wherein said coupling portion comprises a thin layer of soldering tin soldered onto said mounting portion.

3. The antenna according to claim 2, wherein said radiating element comprises a low-frequency radiating portion and a high-frequency radiating portion.

4. The antenna according to claim 3, wherein said high-frequency radiating portion comprises a first high-frequency radiating portion and a second high-frequency radiating portion.

5. The antenna according to claim 4, wherein said low frequency radiating portion, said first high-frequency radiating portion and said second high-frequency radiating portion are disposed in E-shape, with a crossing region formed in said E-shape.

6. The antenna according to claim 5, wherein said radiating portion comprises a through hole through said radiating element.

7. The antenna according to claim 6, wherein said outer conductor is soldered onto said metal plate.

8. The antenna according to claim 1, wherein said radiating portion comprises a through hole defined through both said radiating element and said PCB.

9. The antenna according to claim 8, wherein said inner conductor is connected to an edge of said through hole.

10. The antenna according to claim 9, further comprising a conductive layer arranged on said PCB, said conductive layer connected with said mounting portion.

11. The antenna according to claim 10, wherein said outer conductor is connected to said conductive layer.

12. An antenna comprising:

a radiating portion comprising a radiating element and a printed circuit board (PCB) comprising a mounting portion, said radiating element being on surface of the PCB;

a metal plate comprising a coupling portion on a surface thereof;

a connecting portion connecting said mounting portion and said coupling portion together;

a feed cable comprising an inner conductor and an outer conductor respectively connected with said radiating element and said metal plate;

wherein a portion of said metal plate is overlapped on said printed circuit board, the rest portion of said metal plate is separated from said printed circuit board.

13. An antenna comprising:

a printed circuit board;

a radiating element formed on a portion of the printed circuit board;

a grounding element formed on another portion of the printed circuit board, which is spaced from the radiating element; and a discrete metallic plate attached to the printed circuit board and defining a first region overlapped, in a vertical direction perpendicular to said printed circuit board, with and electrically connected to said grounding element, and a second region extending from an edge of the printed circuit board in a cantilever type, said edge being essentially located right beside the grounding element; wherein said second region is offset from the printed circuit board in said vertical direction, and is equipped with a setting hole via which the metallic plate is allowed to be mounted to a mobile electrical device.

14. The antenna according to claim 13, wherein said grounding element is a mounting portion.

15. The antenna according to claim 14, wherein said mounting portion is coplanar with said radiating element.

* * * * *